US005944025A

United States Patent [19]

Cook et al.

[11] Patent Number: 5,944,025

[45] Date of Patent: Aug. 31, 1999

[54] SMOKELESS METHOD AND ARTICLE UTILIZING CATALYTIC HEAT SOURCE FOR CONTROLLING PRODUCTS OF COMBUSTION

[75] Inventors: Christopher J. Cook, Macon, Ga.; Adriano Polo, Colonial Heights; Matthew H. Zoller, Richmond, both of Va.; Beth E. Waltermire, Wilmington, Del.; Sandra F. Smith, Richmond, Va.

[73] Assignee: Brown & Williamson Tobacco Company, Louisville, Ky.

[21] Appl. No.: 08/774,543

[22] Filed: Dec. 30, 1996

[51] Int. Cl.[6] ..... A24B 15/18; A24B 15/28

[52] U.S. Cl. ..... 131/334; 131/194; 131/331; 131/339; 131/341; 131/361

[58] Field of Search ..... 131/334, 194, 131/195, 339, 361, 341; 502/60, 63, 65, 66

[56] References Cited

U.S. PATENT DOCUMENTS

| | | | |
|---|---|---|---|
| 2,942,601 | 6/1960 | Smith . | |
| 3,169,535 | 2/1965 | Lassiter et al. . | |
| 3,356,094 | 12/1967 | Ellis et al. . | |
| 4,149,548 | 4/1979 | Bradshaw . | |
| 4,180,384 | 12/1979 | Rice . | |
| 4,340,072 | 7/1982 | Bolt et al. . | |
| 4,756,318 | 7/1988 | Clearman et al. . | |
| 4,771,795 | 9/1988 | White et al. . | |
| 4,819,665 | 4/1989 | Roberts et al. . | |
| 4,846,199 | 7/1989 | Rose . | |
| 5,027,836 | 7/1991 | Shannon et al. . | |
| 5,040,551 | 8/1991 | Schlatter et al. | 131/359 |
| 5,115,820 | 5/1992 | Hauser et al. . | |
| 5,130,109 | 7/1992 | Wan . | |
| 5,159,940 | 11/1992 | Hayward et al. . | |
| 5,190,060 | 3/1993 | Gerding et al. . | |
| 5,211,684 | 5/1993 | Shannon et al. . | |
| 5,240,014 | 8/1993 | Deevi et al. . | |
| 5,278,113 | 1/1994 | Ono et al. | 502/66 |
| 5,285,798 | 2/1994 | Banerjee et al. . | |
| 5,320,131 | 6/1994 | Dull . | |
| 5,451,444 | 9/1995 | DeLiso et al. . | |
| 5,501,234 | 3/1996 | Hyre . | |
| 5,730,158 | 3/1998 | Collins et al. . | |

FOREIGN PATENT DOCUMENTS

| | | |
|---|---|---|
| 82 00398 | 1/1982 | France . |
| WO/90/10394 | 9/1990 | WIPO . |

OTHER PUBLICATIONS

Paper entitled "Small Scale Exothermic Catalytic Oxidizer" by Louis J. Hillenbrand (pp. C–1 through C–11).

*Primary Examiner*—Stanley S. Silverman
*Assistant Examiner*—Steven B. Leavitt
*Attorney, Agent, or Firm*—Pennie & Edmonds LLP

[57] ABSTRACT

A smoking article and its method of construction and operation to provide products of combustion which are used to form flavorable aerosol gases delivered to the smoker's mouth while controlling the composition of such gases of combustion. Hot gases generated in a catalytic section in which fuel and air combust aided by a honeycomb catalytically coated surface including alumina and a cerium compound.

75 Claims, 2 Drawing Sheets

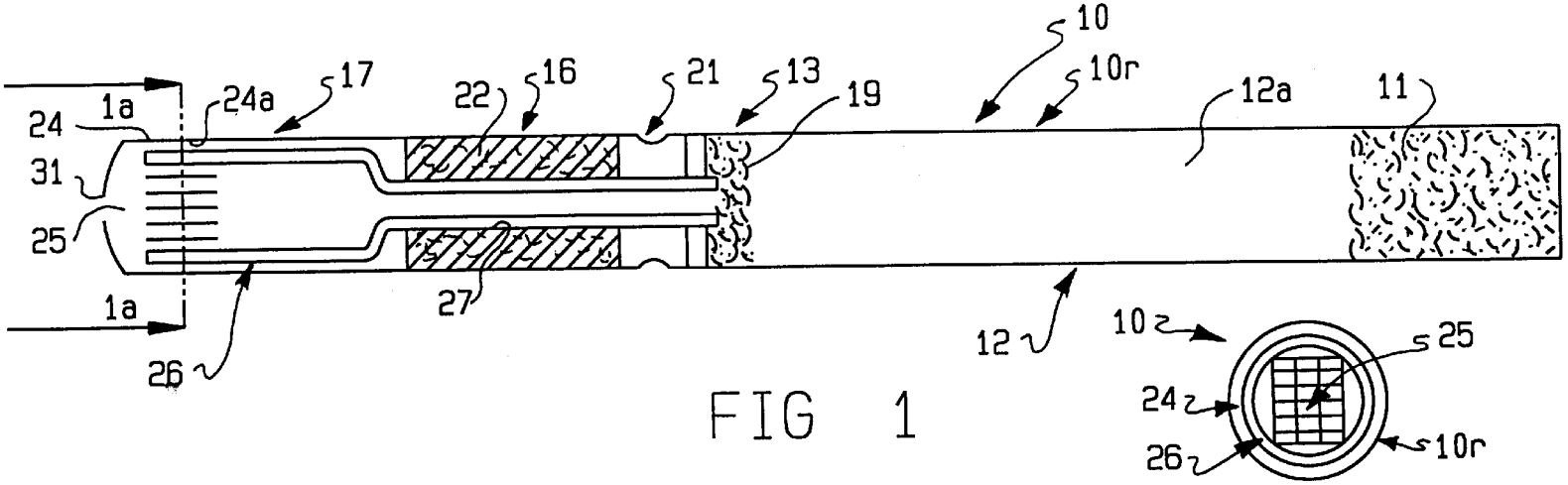
FIG 1
FIG. 1a
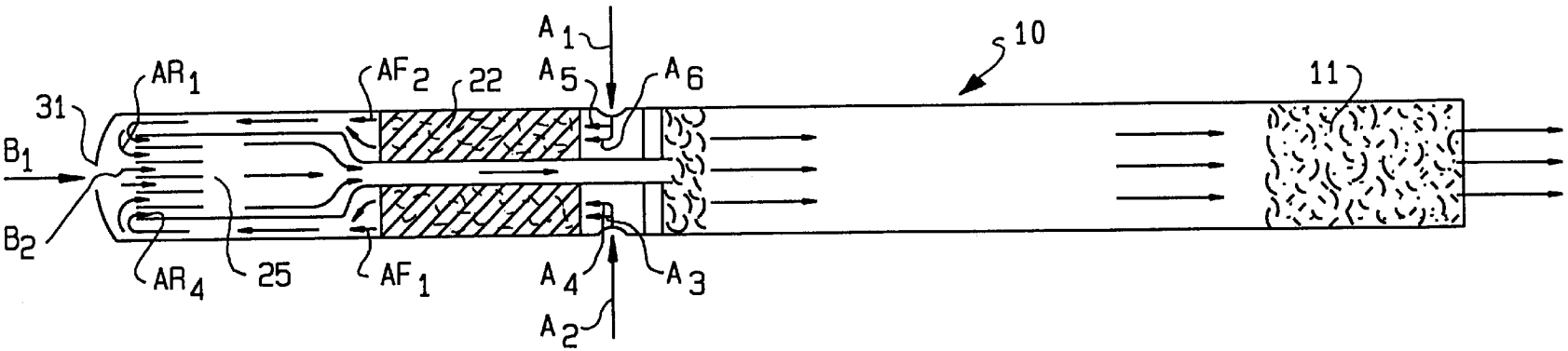
FIG. 2

SMOKELESS METHOD AND ARTICLE UTILIZING CATALYTIC HEAT SOURCE FOR CONTROLLING PRODUCTS OF COMBUSTION

Background of the Invention

Prior proposals have been made to use catalysts in smoking articles where the catalyst is mixed with a carbonaceous material to form a combustible fuel element (U.S. Pat. No. 5,211,684). It has also been proposed to use an aerosol precursor of ceramic material for forming an aerosol in a smoking article (U.S. Pat. No. 5,115,820). The coating of a fuel in a smoker's cigarette with ceria also have been proposed (U.S. Pat. No. 5,040,551).

SUMMARY OF THE INVENTION

Broadly, the present invention comprises a cigarette and its method of construction and a operation including a heat source, a flavorant aerosol portion and a mouthpiece in which the heat source includes a liquid fuel and air mixing chamber and a catalyst burning chamber in which the fuel air mixture combusts under the influence of the catalyst.

The invention includes the method of controlling the products of combustion including the amounts of carbon monoxide produced. Such control is found in the construction and operation of the catalyst substrate arrangement including a supporting matrix and coatings thereon which may include one or more of an alumina coating, a cerium oxide coating and finally a platinum/palladium chloride coating. The oxide and nobel metal coatings are catalytic.

The cigarette of the present invention includes a fuel/air mixing section which contains a liquid absorbent reservoir having liquid fuel therein. Air is moved through the reservoir to pick up fuel particles forming a mixture for delivery to the catalytic combustion chamber. The combustion products are drawn through the flavorant portion including a glycerin to generate a glycerin-based aerosol. The flavored aerosol is then delivered to the mouthpiece of the smoker.

The cigarette of the present invention has the dimensions of and the general appearance of conventional cigarettes.

BRIEF DESCRIPTION OF THE DRAWINGS

FIG. 1 is a plan view of the smoking article of the present invention;

FIG. 1*a* is a sectional view along line 1*a*—1*a* of FIG. 1;

FIG. 2 is the same view as FIG. 1 showing in addition the air, fuel/air mixture and aerosol flow patterns during smoking.

DESCRIPTION OF THE PREFERRED EMBODIMENT

Figure 3A:
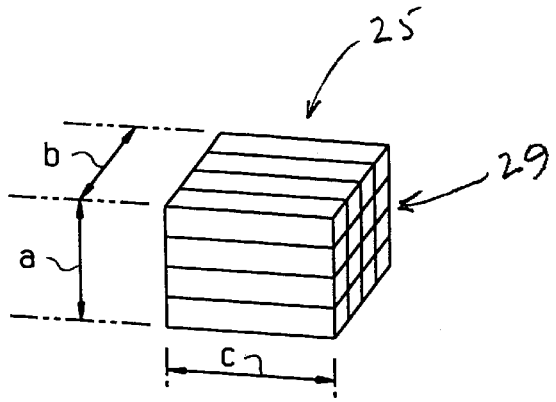
FIGS. 3*a–d* are perspective views of honeycombs used in the present invention.

In the Figures, cigarette or smoking article 10 includes filter mouthpiece section 11, flavorant section 12, aerosol section 13, a fuel storage and air mixing section 16 and a catalytic combustion section 17. Cigarette 10 is defined by outer cylindrical paper wrap 10*r* which may be a single piece of wrap or be composed of attached or overlapping sections. Additional wrappers and tipping paper may be used.

Mouthpiece section 11 is a filter for filtering the gases of cigarette 10 and may be a conventional cigarette filter. Flavorant section 12 is principally cut tobacco 12*a* including top dressing or other materials and flavors to enhance the taste of the gases reaching the smoker's mouth. Preferably, cut tobacco 12*a* fills the space between mouthpiece section 11 and aerosol support material 19.

Aerosol section 13 includes an aerosol support plug 19 with glycerin on it. Alternative to glycerin, polyhydric alcohols such as propylene glycol may be used. Aerosol supporting materials may include carbon mat, magnesium oxide, alumina, glass beads, vermiculite, carbon, aluminum foil and paper coated with hydrolyzed organosiloxanes. The aerosol former can also be added/incorporated into the cut tobacco or a reconstituted tobacco type material. When hot gases of combustion including water vapor water, $CO_2$ and CO are caused to flow through plug 19 a glycerin aerosol is formed.

Fuel storage and air mixing section 16 includes circumferential side ventilation holes 21 through which outside air enters, see A1–A6 in FIG. 2, cigarette 10 as it is smoked as will be further explained. Section 16 includes fuel absorbent reservoir 22 including a wick material for storing liquid fuel in amounts ranging from about 300–500 microliters ($\mu$l). The absorbent fuel reservoir consists of a synthetic fiber liquid transfer wick material which utilizes capillary action. Preferably, Transorb brand wicks are used in the practice of this invention. Reservoir 22 may include any suitable material for holding the liquid fuel and for permitting its mixing with air at the temperature, pressures and air flow velocities present in cigarette 10. The preferred fuel is liquid absolute ethanol. At ambient temperature ethanol to air ratios ranging from 3.3 to 19.0 (by volume) are preferred.

Other combustible fuels such as alcohols, esters, hydrocarbons, methanol, isopropanol, hexane, methyl carbonates of alcoholic flavorings, etc. may be used. Further, heat release fuels may be used which fuels are relatively non-volatile fuel precursors consisting of a volatile fuel component chemically or physically bonded to a support material. Upon heating the volatile fuel component is released. Such fuels have the advantage of preventing evaporative loss of fuel during storage and ensuring the release of fuel in controlled and limited quantities sufficient for combustion and heat generation. Examples of heat release fuels are menthol methyl carbonate, dimethylcarbonate, triethylorthoformate, alcohol absorbed on celite or molecular sieves and "STERNO" brand fuel.

Finally, catalytic activity occurs in section 17 which includes mixture supply tube 24 and inner catalytic-containing ceramic tube 26 which houses honeycomb 25 employing a frictional fit or other attachment means. Ceramic tubes 24, 26 are composed of a dense mullite ($3Al_2O_3.2SiO_2$) in a glassy matrix. The material is fine-grained high temperature operative and nonporous. The material has a bulk specific gravity of 2.4; a working temperature of 1650° C. and a flexural strength of 20,000 psi. Tubes 24 and 26 are preferably made of heat resistant material such as MV20 mullite ceramic tubes from McDanel Refractory Co. Catalytic unit 25 which preferably is Celcor or Celcor 9475 honeycomb ceramic material coated with an alumina, and then coated with a catalyst coating material including a rare earth or transition oxide, such as cerium (IV) oxide, and finally are coated with a catalytic coating material including a precious metal solution, preferably, palladium or platinum. After such coating treatment the honeycomb substrate 25 (see FIGS. 3*a–d*) is placed in cigarette tube 26 (FIGS. 1, 1*a* and 2). In addition to ceramic material any other suitable non-combustible catalyst support material can be used such as non-woven carbon mat, graphite felt, carbon fiber yarn, carbon felt, woven ceramic fibers, monolith materials. Monolith materials, also referred to as honeycomb materials, are commercially available, (e.g., from Corning Glass Works, Corning, N.Y.). Transition oxides such as $Ta_2O_5$, ZnO, $ZrO_2$, $MgTiO_3$, $LaCoO_3$, $RuO_2$, CuO, $MnO_2$, and ZnO may be used instead of cerium oxide.

Honeycomb substrate 25 has low pressure drop, high surface area and a high thermal and mechanical strength. Honeycomb structures have a low pressure drop (the difference in pressure created when pulling air through the support) compared to a tightly packed ceramic fiber material. A typical pressure drop (draw resistance) of a cigarette is five (5) inches of water (gauge), such pressure being measured at the mouth end of the cigarette. The honeycomb preferably has square cells and a formula of $2MgO.2Al_2O_3.5SiO_2$. The honeycomb has open porosity of 33%; mean pore size of 3.5 microns coefficient of thermal expansion (25–1000° C.$\times 10^{-7}$/° C. of 10 and a melting temperature of about 1450° C. The honeycomb material forms a heterogeneous catalyst.

Figure 3B:
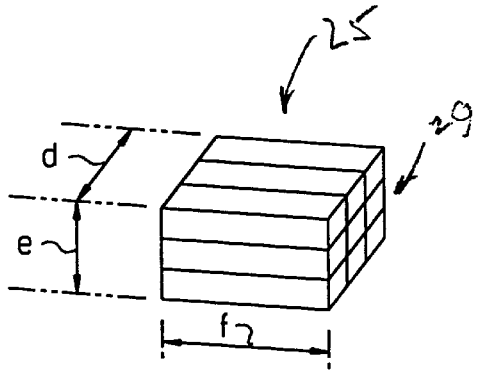
Figure 3C:
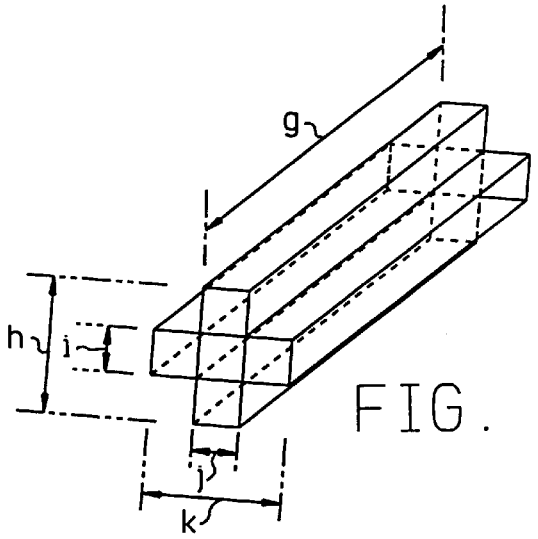
Figure 3D:
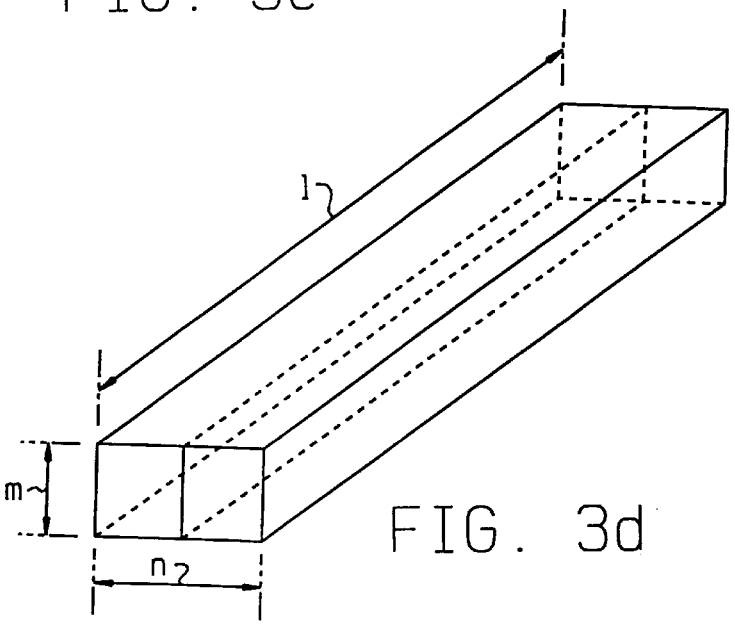

With respect to FIG. 3*a*, honeycomb 25 includes sixteen (16) cells 29. The dimensions of honeycomb 25 are a=5.7 mm; b=5.7 mm and c equals 7 mm. In FIG. 3*b*, honeycomb 25 includes nine (9) cells 29. The dimensions of honeycomb 25 are: d=4.5 mm, e=4.5 mm and f=7 mm. In FIGS. 3*c* and 3*d* dimensions g=13.09±1.17 mm; h=4.3 mm; i=1.8 mm; j=1.8 mm; k=4.3 mm; l=12.29±0.69 mm; m=2.0 mm and n=3.0 mm. FIG. 3*c* shows a unit with five (5) cells and FIG. 3*d* shows a unit with two (2) cells.

Subsequent to the aluminum oxide stabilizer wash coating, which wash coat is stabilized for high temperatures present in the device, honeycomb substrate 25 receives a catalytic treatment. Configurations of Celcor Cordierite illustrated in FIGS. 3*a–d* were catalyzed by treatment as set out in the following examples.

EXAMPLE 1

Two hundred (200) units of Celcor Cordierite #9475 monolith ceramic honeycomb material ($2MgO.2Al_2O_3.5SiO_2$; coated with $\delta$-$Al_2O_3$ stabilizer for high temperature performance, diameter: 4 inch; height: 1 inch; having 400 cells per square inch) was cut into square sections, monolith units, consisting of nine (9) cells with dimensions 4.5 mm×4.5 mm×7 mm (FIG. 3*b*). The honeycomb material was dried 110° C. for about 0.5 to 3 hours to reduce the level of occluded or adhered liquid (including $H_2O$). The two hundred (200) units were then introduced into a heated (90°C.) solution consisting of 200 ml of deionized distilled water and 17.3692 g $Ce(NO_3)_3.6H_2O$. $Ce(NO_3)_3$ is soluble in water. The monolith units, which were agitated by hand every 10 minutes were kept in the heated solution for one-half hour. After removing from the solution, excess liquid was blown from the monolith units with compressed air. The monolith units were then placed on a glass Petri dish and heated at 60° C. on a hot plate for 20 minutes. The monolith units were then dried in air at 110° C. for 1 hour. The above treatment was repeated two more times to give a total of 3 treatments with the $Ce(NO_3)_3$ solution. After the third and final treatment, the monolith units were dried in air at 110° C. overnight so as to substantially dry the impregnated material, and then calcined in air at 550° C. for 5 hours.

The two hundred (200) units so impregnated with $Ce(NO_3)_3$ were divided into four (4) equal lots. Each lot was treated with one of four different solutions of $PdCl_2$.

Solution 1

A 2% (wt/vol) Pd solution prepared by diluting 15.7233 ml $PdCl_2$ solution (0.0318 g Pd/ml) to 25 ml with deionized distilled water.

Solution 2

A 1% (wt/vol) Pd solution prepared by diluting 15.7233 ml $PdCl_2$ solution (0.0318 g Pd/ml) to 50 ml with deionized distilled water.

Solution 3

A 0.5% (wt/vol) Pd solution prepared by diluting 15.7233 ml $PdCl_2$ solution (0.0318 g Pd/ml) to 100 ml with deionized distilled water.

Solution 4

A 0.25% (wt/vol) Pd solution prepared by diluting 15.7233 ml $PdCl_2$ solution (0.0318 g Pd/ml) to 200 ml with deionized distilled water.

Fifty (50) $Ce(NO_3)_3$ impregnated monolith units were added to Solution 1 and heated to 70–80° C. Fifty (50) monolith units were added to each of the other Solutions 2–4 in the same manner. In each case, the monolith units, which were agitated by hand every 10 minutes, were kept in the heated solution for 1 hour. After removing from the solutions, excess liquid was blown from the monolith units with compressed air. The monolith units were then placed on a glass Petri dish and heated at 60° C. on a hot plate for 20 minutes The monolith units were then dried in air at 110° C. overnight and then calcined in air at 550° C. for 5 hours. The units so treated were found useful in the practice of this

EXAMPLE 2

About three hundred (300) dried monolith units, consisting of two (2) cells (FIG. 3*d*) with dimensions 3 mm×3 mm×12.3 mm, were impregnated with $Ce(NO_3)_3.6H_2O$ in a similar manner to that described in Example 1 except that 26.0538 g of $Ce(NO_3)_3.6H_2O$ in 150 ml deionized distilled water was used.

One hundred of the three hundred (300) $Ce(NO_3)_3$ impregnated monolith units were treated with a heated (70°C.) solution containing 1.6667 g $PdCl_2$, 0.25 ml $H_2PtCl_6$ (8 wt % solution in water), 10 ml HCl (1M) and 90 ml deionized distilled water in a similar manner to that described in Example 1. The one hundred treated units were found useful in the practice of the present invention.

EXAMPLE 3

About 60 dried nine (9) cell monolith units were impregnated with $Ce(NO_3)_3.6H_2O$ in a similar manner to that described in Example 1 except that 8.6846 g of $Ce(NO_3)_3.6H_2O$ in 100 ml deionized distilled water was used.

About 30 of the $Ce(NO_3)_3$ impregnated monolith units were treated with a heated (90°C.) solution containing 6.445 g $ZrCl_2O.8H_2O$ in 100 ml of deionized distilled water. The monolith units, which were agitated by hand every 5 minutes, were kept in the heated solution for 0.5 hour. After removing from the solution, excess liquid was blown from the monolith units with compressed air. The monolith units were then placed on a glass Petri dish and heated at 60° C. on a hot plate for 20 minutes. The monolith units were dried in air at 110° C. for 1 hour. The above treatment was repeated two more times to give a total of 3 treatments with the $ZrCl_2O.8H_2O$ solution. After the third and final treatment, the monolith units were dried in air at 110° C. overnight so as to substantially dry the impregnated material, and then calcined in air at 720° C. for 5 hours. The about thirty units were found useful in the practice of this invention.

EXAMPLE 4

Fifteen (15) treated monolith units from Example 3 were added to a 0.005 wt % Pt solution prepared by diluting 0.125 ml platinum chloride solution (8 wt % Pt in water) to 200 ml with deionized distilled water. After being immersed in the solution for 10 minutes, the monolith units were removed and excess liquid removed with compressed air. The monolith units were then placed on a glass Petri dish and heated at 60° C. on a hot plate for 20 minutes. The monolith units were then dried in air at 110° C. overnight and then calcined in air at 720° C. for 5 hours. The fifteen units so treated were useful in the practice of the present invention.

EXAMPLE 5

About thirty (30) dried 9 cell monolith units were impregnated with $ZrCl_2O.8H_2O$ in a similar manner to that described in Example 3.

Fifteen (15) of the $ZrCl_2O.8H_2O$ impregnated monolith units were treated with $Ce(NO_3)_3.6H_2O$ in a similar manner to that described in Example 3 except that a calcination temperature of 720° C. was used. The fifteen units so treated were useful in the practice of the present invention.

EXAMPLE 6

Fifteen (15) treated monolith units from Example 5 were treated with a 0.005% Pt solution in a similar manner to that described in Example 4.

Ceramic cordierite units may have cell densities from 9 to 400 cell/in$^2$. Such cells are coated with a uniform layer of gamma (γ) alumina to increase the stability and the coating surface by one hundred fold or more as described in the Examples above. Generally, the alumina coating is in turn coated with a solution of $Ce(NO_3)_{31}$ or a slurry of ceria (cerium oxide: $CeO_2$). Cerium nitrate $Ce(NO_3)_3$ is preferred because a more uniform coating can be obtained. Cerium compounds including cerium (III) oxalate carbonate, or nitrate may be used as starter materials provided they are converted to cerium (IV) oxide prior to use in the invention.

Finally, a third coat of a dilute solution of platinum chloride or palladium chloride is applied on the cerium containing coating. These catalyst coatings, when activated (as combustion is initiated) generate temperatures from about 700° C. up to 1000° C. The high temperatures assist in achieving complete combustion of the liquid fuel and air mixture and achieving the further combustion of carbon monoxide (CO).

In the operation of cigarette 10, the smoker draws on mouthpiece section 11 causing outside air to flow through side holes 21 in fuel storage and air mixing section 16 and, in addition, outside air to flow through end hole 31 in section 17 (see 4) air flow arrows $AF_1$ and $AF_2$ arrows $B_1$ and $B_2$ (FIG. 2)). Outside air flow represented by arrows $AF_1$ and $AF_2$passes through reservoir 16 containing ethanol fuel where a fuel/air mixture is formed. The air/fuel mixture is saturated as it exits reservoir 22. The air/fuel ratio is increased with air drawn through tip opening 31 before the mixture contacts the catalyst surfaces of honeycomb 25. The catalytic surfaces over which the gases flow are about 16 to 65 m$^2$/g. The fuel/air mixture changes direction and commences flowing toward mouthpiece 11. As the air/fuel mixture flows, it comes into contact with coated ceramic honeycomb 25 inside tube 26 as the cigarette 10 is lit with a conventional lighter by applying the lighter to the area of tip hole 31. As the gases continue to move toward mouthpiece 11 they are heated by catalyzed combustion (see arrow $AR_1$ and $AR_4$; FIG. 2). Gas flow continues through delivery tube 27.

As the smoker continues to draw on cigarette 10, combustion gases pass out of delivery tube 27 through glycerin containing plug support 19 forming glycerin aerosol which flows through section 10 picking up flavors from cut tobacco 12*a*. The aerosol laden with flavorants finally passes through mouthpiece filter 11 to the smoker's mouth. When the smoker stops drawing the catalyst retains sufficient heat in section 17 so that upon the smoker's taking second and subsequent drags combustion will resume without the requirement of relighting.

The products of combustion exiting delivery tube 27 and finally reaching the smoker's mouth are water, $CO_2$ and CO. The weight of CO per cigarette is less than the weight found in standard cigarettes presently being sold. For example, cigarettes of the present invention have 0.2 mg or below of CO per cigarette.

Reductions in CO are attributable to the procedure in which mixture of air and fuel pass through the honeycomb material which functions as coated and catalyst as herein described. During such flow catalytic action causes oxidation of CO to $CO_2$ to substantially reduce the CO content as such gases exit tube 27.

In view of the heat generated in combustion section 17 his section may be insulated using aluminum foil/paper laminates, graphite foil, glass fiber, non-woven carbon mats and woven ceramic fibers. Such insulation also maintains the catalyst above its light-off (activation) temperature between puffs.

The catalyst containing portion of the smoking article can be reused. It is contemplated a pack or carton of smoking articles may include one or more catalyst units to which the smoker would attach to the end of the smoking device.

The term "smokeless" means to many in the cigarette industry, a device that heats rather than burns the tobacco. "Flameless" refers to catalytic flameless combustion including catalytic oxidation of volatile organic vapors on a metal or metal oxide. The present inventive device is both "smokeless" and "flameless".

When all the fuel in reservoir 22 has been consumed, cigarette 10 extinguishes itself. Cigarette 10 is designed to produce about 6 to 12 puffs.

We claim:

1. A smoking article with a mouthpiece section and a tip end in which gases flow to the mouthpiece section in a downstream direction with a plurality of sections upstream of said mouthpiece section comprising a. a heat source portion positioned at the tip end for producing gases of combustion in turn comprising
   (1) side ventilation holes in the article to serve the heat source portion through which outside air enters;
   (2) an absorbent fuel reservoir further away from the mouthpiece than the ventilation holes through which such air flows to create an air/fuel mixture;
   (3) a catalyst combustion section further away from the mouthpiece than the fuel reservoir into which and through which the fuel/air mixture flows as such mixture combusts therein to form combustion gases, which catalyst combustion section includes means for guiding such fuel and air mixture to reverse direction away from the mouthpiece toward the mouthpiece;
   (4) a downstream conduit associated with the combustion section to deliver the gases of combustion toward the mouthpiece;

b. an aerosol section into which and through which the gases of combustion flow to form an aerosol and c. a tobacco section into which the aerosol flows as it moves further downstream toward the mouthpiece section.

2. The article of claim 1 in which the catalyst combustion section includes a honeycomb ceramic substrate coated with alumina which in turn is covered with first catalytic coating.

3. The article of claim 2 in which the first catalytic coating is a rare earth oxide.

4. The article of claim 3 in which the first catalytic coating includes cerium nitrate.

5. The article of claim 3 in which the rare earth oxide is cerium oxide.

6. The article of claim 2 in which the first catalytic coating is a transition oxide.

7. The article of claim 2 in which the substrate is further covered with a second catalytic coating including a nobel metal.

8. The article of claim 7 in which the nobel metal is palladium.

9. The article of claim 7 in which the catalytic coating surface area over which the combustion gases flow is about 16 to 65 $m^2/g$.

10. The article of claim 2 in which the alumina is gamma alumina.

11. The article of claim 2 in which the first catalytic coating contains cerium IV oxide.

12. The article of claim 2 in which the first catalytic coating contains $Ce(NO_3)_3$.

13. The article of claim 2 in which the catalytic coating surface area over which the combustion gases flow is about 16 to 65 $m^2$ /g.

14. The article of claim 2 in which the ceramic substrate is cordierite material.

15. The article of claim 1 in which the reservoir holds absolute ethanol therein as the fuel.

16. The article of claim 1 in which the ceramic section includes a substrate having a cell density of 9 to 400 cells/$inch^2$.

17. A cigarette with a mouthpiece for generating flavorful gases for drawing downstream toward and through the mouthpiece comprising (a) a flameless heat source portion adjacent the tip end mouthpiece for generating heated gases including
  i) a reservoir unit containing fuel;
  ii) conduit means passing into and out of the reservoir unit so that when the cigarette is drawn on a suitable air/fuel mixture is formed which mixture is delivered to a fuel burning catalyst section in which combustion gases are formed;
  iii) such fuel burning catalyst section including a honeycomb support coated with layers of alumina, cerium compound and a nobel metal compound;

(b) means for causing the fuel and air mixture to reverse direction as it enters the catalyst section; and (c) a flavorant section downstream of the fuel burning catalyst for receiving and flavoring the combustion gases as they flow to the mouthpiece;

whereby the article when lit and drawn upon hot gases pass from the fuel burning catalyst section through the flavorant section to the mouthpiece.

18. The article of claim 17 in which the honeycomb support is cordierite with a structure of about 400 cell/$in^2$.

19. The cigarette of claim 17 in which the cerium compound layer includes ceria.

20. The cigarette of claim 19 in which the cerium compound layer includes cerium nitrate.

21. The cigarette of claim 19 in which the cerium compound layer includes cerium (IV) oxide.

22. A method of producing an aerosol in a cigarette including creating gases of combustion and transporting them in a series of puffs from the cigarette being first lit until it stops producing aerosol puffs through an aerosol producing section to the smoker's mouth comprising a) providing a article body having an absorbent fuel reservoir therein in which a selected amount of available liquid fuel and air are intermittently mixed to form a series of fuel/air mixtures;

b) further providing a ceramic catalyst combustion section coated with one or more catalytic layers;

c) causing such fuel/air mixtures to be serially transported into the ceramic catalyst combustion section for combustion therein such mixtures during combustion flowing,
  (1) over the surface area of such layers;
  (2) said surface area being such that the combustion gases resulting from such passage of such series of fuel/air mixtures into and through the combustion section and over such area produce a selected total weight of $CO_2$, a total weight of water and a total weight of CO and wherein the total weight of CO is about 0.2 mg for such series of puffs.

23. The method of claim 22 in which the creation of the combustion section includes the steps of a) providing a ceramic honeycomb substrate support in the section;

b) placing a coating of alumina on the substrate support; and c) placing a catalytic coating on the alumina coating.

24. The method of providing gaseous materials to a person's mouth comprising a) providing a tube having a mouthpiece and chamber for receiving a honeycomb material;

b) coating the honeycomb material with an aluminum oxide stabilizer;

c) drying the coated honeycomb material;

d) introducing the honeycomb material in a solution of water $Ce(NO_3)_3.H_2O$;

e) agitating the honeycomb material in said solution;

f) thereafter heating the honeycomb material;

g) drying the honeycomb material and positioning it in such chamber;

h) providing a fuel/air mixing section in which a mixture of fuel and air is created when a person draws on such tube;

i) causing such fuel and air mixture to flow over the honeycomb material in such chamber under conditions of combustion of such fuel and air mixture; and j) causing flow of such combustion gases to pass downstream through an aerosol section and to the person's mouth.

25. The method of claim 24 having the additional steps of a) providing a ceramic honeycomb substrate;

b) placing a coating of alumina on the substrate;

c) placing a coating of cerium oxide (IV) on the alumina coating; and d) placing a coating of platinum chloride on the cerium oxide coating.

26. A method of providing gases to a smoker's mouth comprising providing a smoking article of having a side, a mouthpiece end and a tip end;

placing side ventilation holes between the mouthpiece and tip end;

locating within the article of a fuel reservoir for receiving air entering the ventilation holes when the smoke draws on the article;

causing a fuel and air mixture to flow away from the mouthpiece from the reservoir to a catalytic combustion section where the fuel air mixture is burned;

thereafter causing the fuel and air mixture to reverse flow toward the mouthpiece during which travel it passes through an aerosol generating section and unburned tobacco.

27. The method of claim 26 in which the catalytic combustion section has a substrate coated with alumina.

28. The method of claim 27 in which the coated substrate has a first catalytic coating thereon.

29. The method of claim 28 in which the first catalytic coating is a rare earth oxide.

30. The method of claim 29 in which the rare earth oxide is cerium oxide.

31. The method of claim 30 in which the catalytic coating surface area over which the combustion gases flow is about 16 to 65 $m^2/g$.

32. The method of claim 28 in which the first catalytic coating is a transition oxide.

33. The method of claim 28 in which the first catalytic coating includes cerium nitrate.

34. The method of claim 28 in which the first catalytic coating contains cerium IV oxide.

35. The method of claim 28 in which the first catalytic coating contains $Ce(NO_3)_3$.

36. The method of claim 28 in which the catalytic coating surface area over which the combustion gases flow is about 16 to 65 $m^2/g$.

37. The method of claim 27 in which the substrate is further covered with a second catalytic coating including a nobel metal.

38. The method of claim 37 in which the nobel metal is palladium.

39. The method of claim 27 in which the alumina is gamma alumina.

40. The method of claim 27 in which the ceramic substrate is cordierite material.

41. The method of claim 26 in which the reservoir holds absolute ethanol therein as the fuel.

42. The method of claim 26 in which the ceramic section includes a substrate having a cell density of 9 to 400 cells/$inch^2$.

43. A smoking article of with a mouthpiece for generating flavorful gases for drawing through the mouthpiece comprising (a) a flameless heat source portion for generating heated gases including i) a reservoir unit containing fluid fuel;

ii) conduit means passing into and out of the reservoir unit so that when the cigarette is drawn on a suitable air/fuel mixture is formed;

iii) a catalyst combustion section into which the air/fluid mixture is drawn for combustion therein which includes a honeycomb support coated with a layer of alumina and a layer of catalytic coating which section has a passageway therethrough in which the fuel/air mixture combusts to form gases of combustion which exit the section; and (b) a flavorant portion for receiving the gases of combustion whereby the smoking article of when lit and drawn upon gases of combustion pass from the heat source portion to and through the flavorant portion to the mouthpiece.

44. The article of claim 43 in which the catalytic coating is a rare earth oxide.

45. The article of claim 44 in which the rare earth oxide is cerium oxide.

46. The article of claim 43 in which the catalytic coating is a transition oxide.

47. The article of claim 43 in which the catalytic coating includes cerium nitrate.

48. The article of claim 43 in which the substrate is further covered with a second catalytic coating including a nobel metal.

49. The article of claim 48 in which the nobel metal is palladium.

50. The article of claim 48 in which the catalytic coating surface area over which the combustion gases flow is about 16 to 65 $m^2/g$.

51. (new) The article of claim 43 in which the support is coated with the alumina.

52. The article of claim 43 in which the alumina is gamma alumina.

53. The article of claim 43 in which the catalytic coating contains cerium IV oxide.

54. The article of claim 43 in which the catalytic coating contains $Ce(NO_3)_3$.

55. The article of claim 43 in which the reservoir unit holds absolute ethanol therein as the fuel.

56. The article of claim 43 in which the honeycomb support includes a substrate having a cell density of 9 to 400 cells/$inch^2$.

57. The article of claim 43 in which the catalytic coating surface area over which the combustion gases flow is about 16 to 65 $m^2/g$.

58. The article of claim 43 in which the ceramic substrate is cordierite material.

59. A method of providing gases to a smoker's mouth comprising providing a smoking article of having a side, a mouthpiece and tip end;

placing side ventilation holes between the mouthpiece and tip end;

locating within the article of a fluid fuel reservoir for receiving air entering the ventilation holes when the smoker draws on the article;

causing a fuel and air mixture to flow from the reservoir to a catalytic combustion section with honeycomb substrate support for supporting layers of catalytic materials where the fuel and air mixture is burned; and thereafter causing the combustion gases to flow toward the mouthpiece during which travel they pass through an aerosol generating section and unburned tobacco.

60. The method of claim 59 in which the catalytic combustion section has a substrate coated with alumina.

61. The method of claim 60 in which the coated substrate has a first catalytic coating thereon.

62. The method of claim 61 in which the first catalytic coating is a rare earth oxide.

63. The method of claim 62 in which the rare earth oxide is cerium oxide.

64. The method of claim 63 in which the reservoir holds absolute ethanol therein as the fuel.

65. The method of claim 63 in which the catalytic coating surface area over which the combustion gases flow is about 16 to 65 $m^2/g$.

66. The method of claim 61 in which the first catalytic coating is a transition oxide.

67. The method of claim 61 in which the first catalytic coating includes cerium nitrate.

68. The method of claim 61 in which the first catalytic coating contains cerium IV oxide.

69. The method of claim 61 in which the first catalytic coating contains $Ce(NO_3)_3$.

70. The method of claim 61 in which the catalytic coating surface area over which the combustion gases flow is about 16 to 65 $m^2/g$.

71. The method of claim 60 in which the substrate is further covered with a second catalytic coating including a nobel metal.

72. The method of claim 71 in which the nobel metal is palladium.

73. The method of claim 60 in which the alumina is gamma alumina.

74. The method of claim 60 in which the ceramic substrate is cordierite material.

75. The method of claim 59 in which the ceramic section includes a substrate having a cell density of 9 to 400 cells/$inch^2$.

* * * * *

UNITED STATES PATENT AND TRADEMARK OFFICE
CERTIFICATE OF CORRECTION

PATENT NO. : 5,944,025

DATED : August 31, 1999

INVENTOR(S) : Christopher J. Cook, Adriano Polo, Matthew H. Zoller, Beth E. Waltermire and Sandra F. Smith It is certified that error appears in the above-identified patent and that said Letters Patent is hereby corrected as shown below:

Column 2, line 12, "water vapor water," should read --water vapor,--.

Column 3, line 42, "was dried" should read --was dried in air at--.

Column 4, line 28, "of this" should read --of this invention--.

Column 5, line 51, "(see 4) air flow arrows $AF_1$ and $AF_2$ arrows $B_1$ and" should read --(see four (4) air flow arrows $AF_1$ and $AF_4$ and arrows $B_1$ and--.

Column 5, line 53, "$AF_2$" should read --$AF_4$--.

Column 6, line 23, "his" should read --this--.

Column 7, line 60, "article" should read --cigarette--.

Column 8, line 6, "a article body" should read --a cigarette body--.

Column 9, line 52, "article of with" should read --article with--.

Column 10, line 3, "article of when" should read --article when--.

UNITED STATES PATENT AND TRADEMARK OFFICE

CERTIFICATE OF CORRECTION

PATENT NO. : 5,944,025
DATED : August 31, 1999
INVENTOR(S) : Christopher J. Cook, et al.

It is certified that error appears in the above-identified patent and that said Letters Patent is hereby corrected as shown below:

Column 10, line 25, "claim 43" should read --claim 51--.

Column 10, line 43, "article of having" should read --article having--.

Signed and Sealed this

Sixteenth Day of May, 2000

*Attest:*

Q. TODD DICKINSON

*Attesting Officer*

*Director of Patents and Trademarks*